US008904942B2

(12) United States Patent
Herzog et al.

(10) Patent No.: US 8,904,942 B2
(45) Date of Patent: Dec. 9, 2014

(54) SYSTEM FOR GUIDING RAILS ON A RAIL TRAIN

(71) Applicant: Herzog Railroad Services, Inc., St. Joseph, MO (US)

(72) Inventors: Stanley M. Herzog, St. Joseph, MO (US); Ivan E. Bounds, St. Joseph, MO (US)

(73) Assignee: Herzog Railroad Services, Inc., St. Joseph, MO (US)

( * ) Notice: Subject to any disclaimer, the term of this patent is extended or adjusted under 35 U.S.C. 154(b) by 0 days.

(21) Appl. No.: 14/082,377

(22) Filed: Nov. 18, 2013

(65) Prior Publication Data

US 2014/0251174 A1 Sep. 11, 2014

Related U.S. Application Data

(60) Provisional application No. 61/776,153, filed on Mar. 11, 2013.

(51) Int. Cl.
*E01B 29/16* (2006.01)
*E01B 29/17* (2006.01)

(52) U.S. Cl.
CPC ..... *E01B 29/17* (2013.01)
USPC ..... 104/2; 104/5; 105/355; 414/339

(58) Field of Classification Search
CPC ..... E01B 29/17; E01B 29/16
USPC ..... 104/2, 5, 7.1; 414/339, 529, 338, 501; 105/355; 294/103.1, 85
See application file for complete search history.

(56) References Cited

U.S. PATENT DOCUMENTS

| | | | |
|---|---|---|---|
| 1,091,323 | A | 3/1914 | Fox |
| 3,266,577 | A | 8/1966 | Turner |
| 3,288,082 | A | 11/1966 | Brosnan |
| 4,522,323 | A | 6/1985 | LaBounty |
| 5,297,482 | A | 3/1994 | Cleveland |
| 5,520,497 | A | 5/1996 | Hertelendi et al. |
| 5,630,365 | A | 5/1997 | Hertelendi |
| 5,762,464 | A | 6/1998 | Hertelendi |

(Continued)

OTHER PUBLICATIONS

Photographs of guide shoe for guiding rails loaded onto a rail train including a follower attached to the shoe and engaging an adjacent rail to guide a subsequent loaded rail onto the rail train, in public use prior to invention herein.

(Continued)

*Primary Examiner* — Mark Le
(74) *Attorney, Agent, or Firm* — Erickson Kernell Derusseau & Kleypas, LLC

(57) ABSTRACT

A rail guide for loading railroad rails onto a rail train. The rail guide includes a guide beam disposed to depend vertically downward over each shelf in a rack on a rack car. The guide beam extends substantially the length of the rack car and is coupled to a corresponding guide beam of an adjacent car via a bridge that is configured to accommodate relative movement between the cars. A shoe is provided that is coupled to a leading end of a rail to be loaded. The shoe includes a follower that engages the guide beam to guide a rail being loaded along a path defined by the guide beam. The guide beam can provide vertical and lateral support to the leading end of the rail during loading.

24 Claims, 10 Drawing Sheets

(56) References Cited

U.S. PATENT DOCUMENTS

| | | | | |
|---|---|---|---|---|
| 7,350,467 | B2 | 4/2008 | Green et al. | |
| 7,370,586 | B2 | 5/2008 | McHale et al. | |
| 2008/0163781 | A1 | 7/2008 | Green et al. | |
| 2011/0041721 | A1 * | 2/2011 | Bounds | 104/2 |
| 2012/0199038 | A1 | 8/2012 | Herzog et al. | |

OTHER PUBLICATIONS

International Search Report mailed Jun. 23, 2014 for corresponding International Application No. PCT/US2014/020492.

Written Opinion of the International Searching Authority mailed Jun. 23, 2014 for corresponding International Application No. PCT/US2014/020492.

* cited by examiner

SYSTEM FOR GUIDING RAILS ON A RAIL TRAIN

CROSS-REFERENCE TO RELATED APPLICATIONS

This application claims priority to U.S. Provisional Patent Application No. 61/776,153 filed Mar. 11, 2013 the disclosure of which is hereby incorporated herein in its entirety by reference.

BACKGROUND

Modern railroad tracks are constructed using long sections of ribbon rail. The sections are often found in lengths up to about 1700 feet but can range up to 2000 feet or longer. Shorter sections of lengths as little as 300-320 feet are also available. These sections of ribbon rail are formed by butt-welding multiple sticks of rail, which traditionally come from a steel mill in thirty-nine foot or seventy-eight foot lengths. The welding of the ribbon rails is done at a welding plant and the welded ribbon rails are transported to their installation site on a specially constructed rail train. When existing track is being replaced, ribbon rails may be unloaded from the rail train using a rail unloading machine, such as the rail unloading machines disclosed in U.S. Pat. Nos. 6,981,452 and 7,707,943, both to Herzog et al. The rail-unloading machine pulls one or two rails off of the rail train as the rail train moves down the existing track and lays it alongside the existing rails.

Prior art rail trains traditionally comprise a plurality of sixty-foot-long flatcars connected together by standard railroad couplers. Each car includes a pair of transverse stands for supporting the ribbon rail. The stands of each car are spaced 30 feet apart and 32 feet from the respective coupler such that the stands are spaced 30 feet apart along the length of the rail train. The stands each include multiple tiers (typically five or six tiers) which each support a plurality of rails, for example, eight to twelve rails per tier. The space in which an individual stick of rail is supported on each shelf may be referred to as a pocket. The stands must each be strong enough both to support the weight of the rails and to resist side loads created by flexing of the ribbon rails as the rail train traverses curves in the track. Sidewalls of each stand constrain the rails on the shelves. Thirty-foot spacing of the stands is believed to be optimal for supporting the rails without excessive sagging of the rails between the stands.

The rails are loaded or threaded onto the rail train and across the shelves of the racks by a powered drive system. Considerable effort is required to carefully thread each rail into a desired pocket on each shelf. Loading the first rail on each shelf is the most difficult as it is difficult to thread the rail through a desired pocket of each rail support shelf, particularly when the rail train is sitting on a curved section of track as the end of the rail wants to move in a straight line and the leading end tends to sag.

A common practice to assist in guiding a rail through the selected pocket on the rack car shelves is to mount a pointed shoe on the end of each rail, but it is still difficult to keep the stick of rail traveling in a curved path if the train is curved. Once the first rail is loaded on each self, a guide arm can be attached to a shoe mounted on the leading end of the next rail to be loaded with the guide arm having a receiver positioned over the head of the previously loaded rail. The receiver slides along the head of the previously loaded rail as the next rail is loaded so as to guide the end of the rail being loaded in alignment with the desired pocket of each shelf and to maintain proper spacing between the rail being loaded and the previously loaded rail. Because there is not a previously loaded rail to use in guiding the first rail in place, workers may have to use pry bars and the like to manually redirect the end of the rail through the desired pockets and prevent the end of the rail being loaded from extending into another pocket or outside of the sidewall of the support rack across which it is being loaded.

At least one car in each rail train is a tie-down car including a specialized stand that includes means for fixing the rails to the racks to prevent longitudinal movement of the rails relative to the tie-down car. The fixing means generally includes a plurality of clamping blocks that are bolted to the stand on opposite sides of each rail so as to bear against the foot or base flange of the rail and clamp it against the stand. Typically each clamping block is held down by three or four large bolts which must be installed or removed using an impact wrench or the like. All the other racks in the train allow for relative longitudinal movement of the rails and may include rollers that support the rails. This relative movement between the racks and the rails is required in order to allow the rails to flex without stretching or compressing as the train traverses curves in the track, as well as to allow for coupler slack that exists in each of the couplers between cars.

Each coupler has up to approximately six inches of slack. Coupler slack may necessitate that the tie-down car be positioned near the center of the rail train so as to evenly divide the rails and to thereby insure that neither the forward end nor the rearward end of the rail can move a sufficient distance relative to the nearest adjacent rack that the end will fall off of the rack.

There remains a need for an improved system for guiding rails being loaded onto the cars of a rail train and in particular onto the rail rack cars of a rail train.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief, this disclosure describes, among other things, an apparatus to facilitate the loading of railroad ribbon rails on rack cars of a rail train and in particular guides for guiding ribbon rail onto shelves of the rack cars and shoes for guiding the front end of the ribbon rail therethrough.

Each shelf of the rack cars is provided with a guide beam extending therebetween and spanning substantially the length of the car. The guide beam is supported on the respective shelf or is suspended from a vertically adjacent shelf.

A bridge is provided to couple between opposing ends of corresponding guide beams of consecutive cars. The bridge is configured to pivot vertically and laterally to account for relative movements between the cars. The bridge is also extensible to accommodate relative movement of the cars toward and away from one another, which may result from the take up of coupler slack between the cars.

A shoe, attached to the front of the first rail to be loaded on each shelf, facilitates threading the rail through aligned pockets of successive shelves of the cars in the rail train. The shoe includes a follower coupled thereto that slideably engages or captures the guide beam associated with a shelf onto which the rail is to be loaded. The follower moves along the guide beam to direct the rail into a desired pocket. Engagement of the follower with the guide beam may also provide vertical support for the end of the rail as the end passes between stands or racks on the cars of the rail train.

After the first rail is loaded onto the shelf, a rail spacing guide is attached to the shoe attached to the next rails to be loaded. The spacing guide includes a downwardly opening channel member on a guide arm connected to the shoe that engages the head of a previously loaded rail to guide the next loaded rail in the proper spacing through the next set of aligned pockets of the respective shelves in the rail train.

DESCRIPTION OF THE DRAWINGS

Illustrative embodiments of the invention are described in detail below with reference to the attached drawing figures, and wherein.

DETAILED DESCRIPTION

Figure 1:
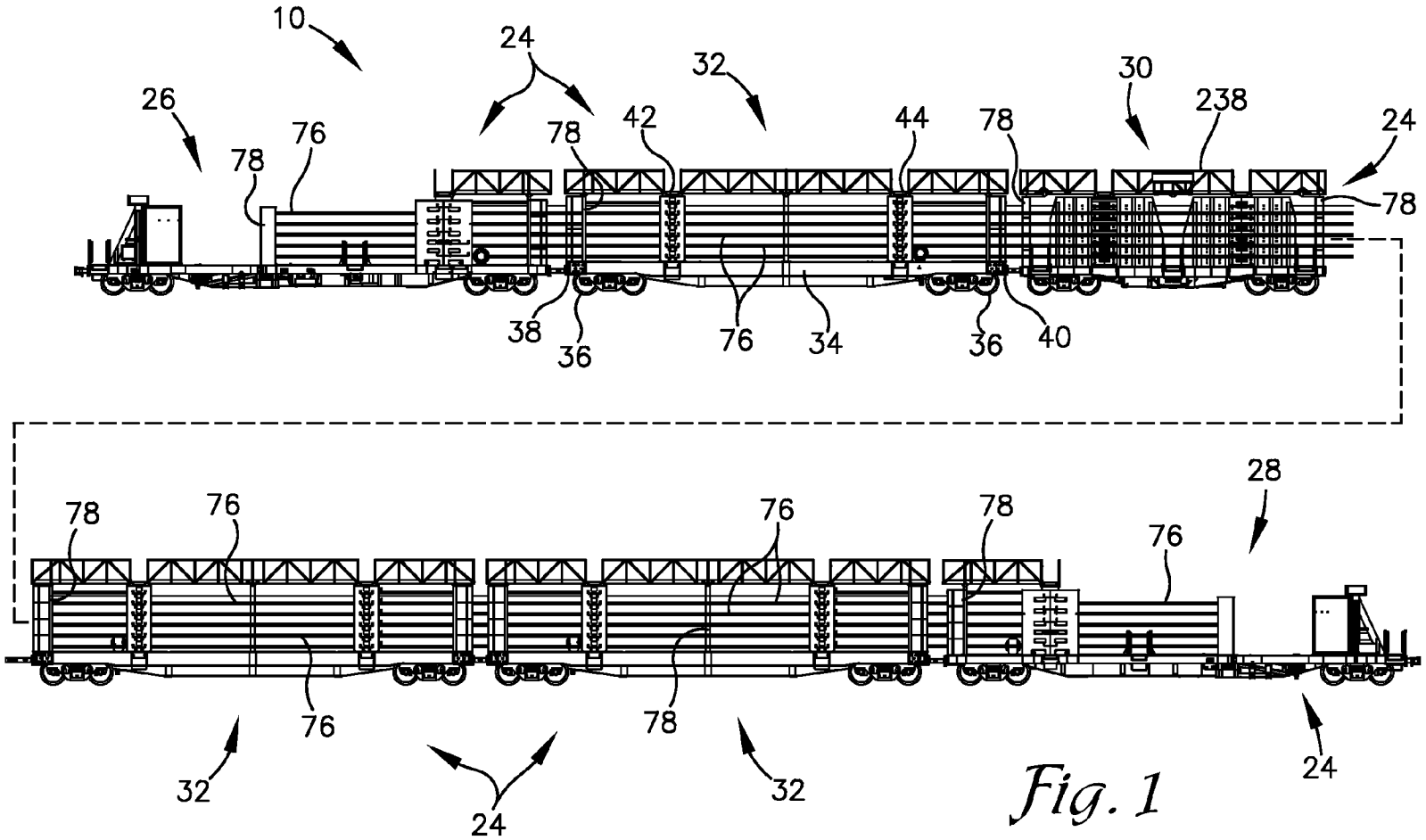
FIG. 1 is a side elevational view of a rail train with a rail-guide system depicted in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention are described herein with respect to the drawings in which reference numerals are employed to identify particular components or features. Corresponding elements in the various embodiments depicted are provided with corresponding reference numerals. Such is provided to avoid redundant description of the elements but is not intended to indicate the elements are necessarily the same.

Figure 2:
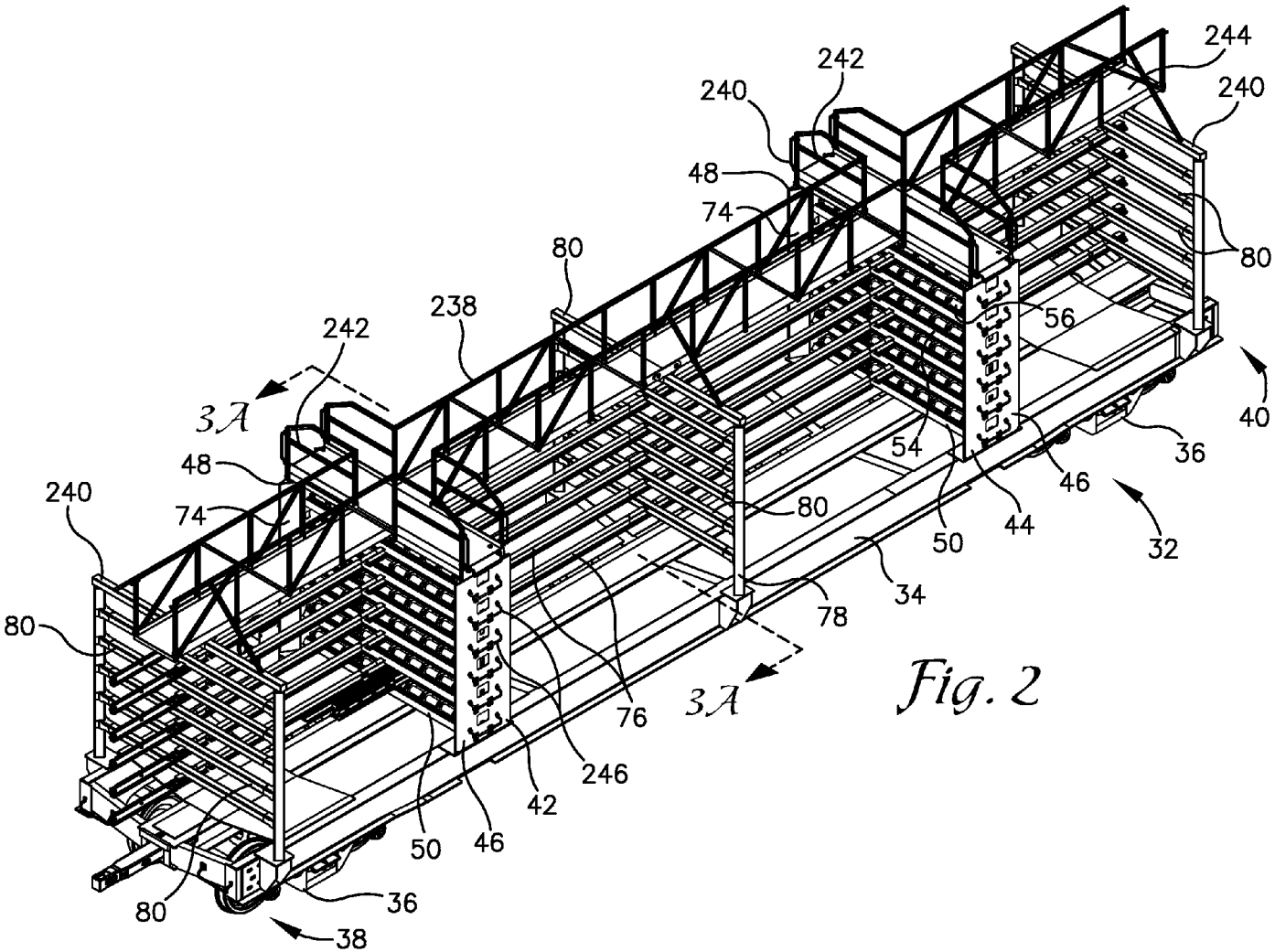
FIG. 2 is a perspective view of a rail car of the rail train depicted in FIG. 1.
Figure 3B:
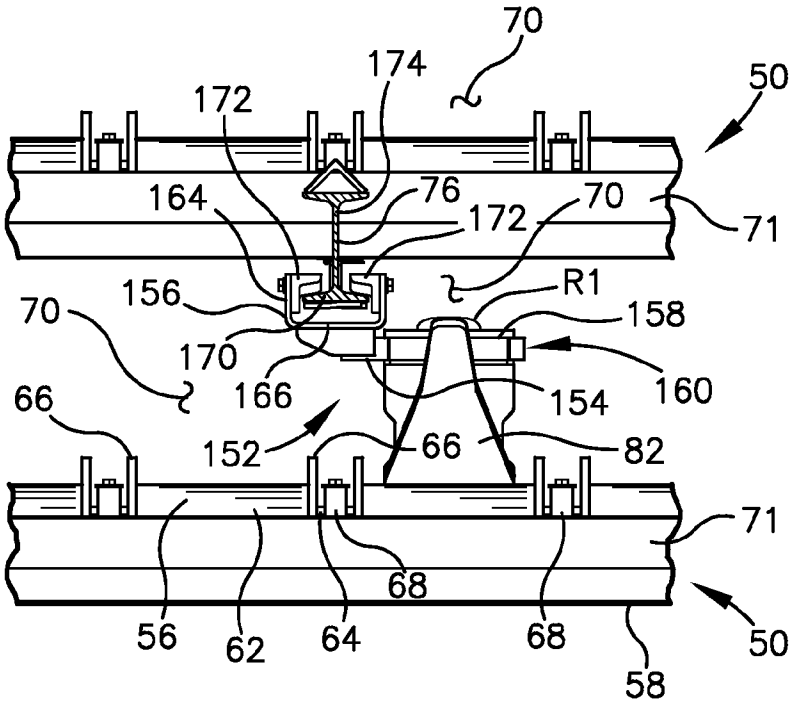
FIG. 3B is an enlarged fragmentary view of the rail-guide system depicted in FIG. 3A.
Figure 3A:
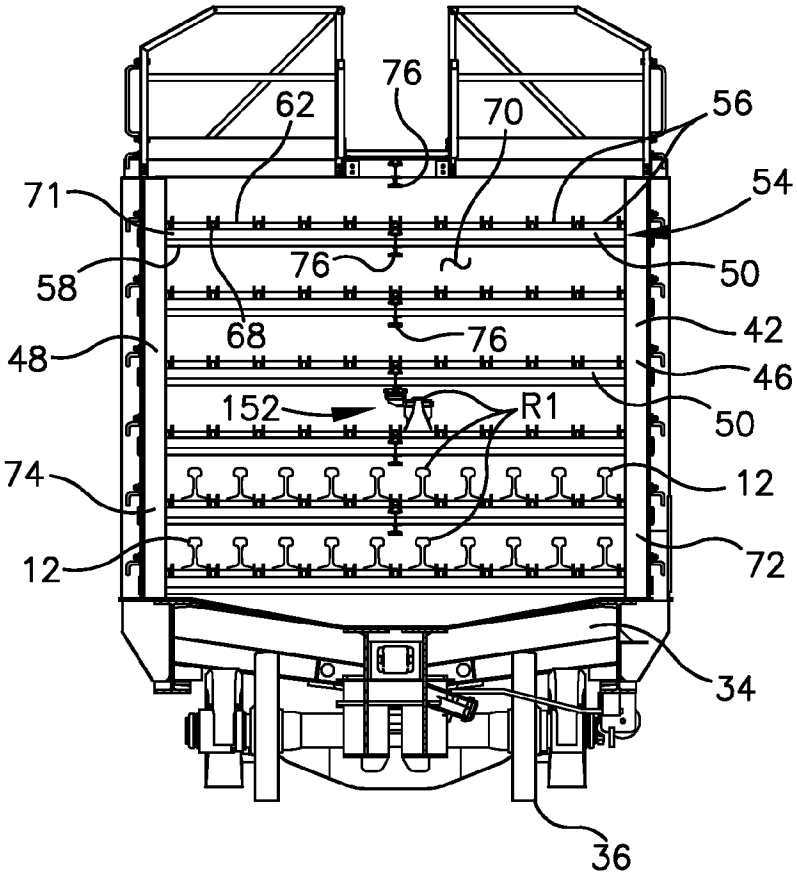
FIG. 3A is cross-sectional view of the rail car of FIG. 2 taken along the line 3A-3A and depicting depending rail-guide beams of a rail-guide system disposed offset from pockets on the rail car in accordance with an embodiment of the invention.
Figure 3C:
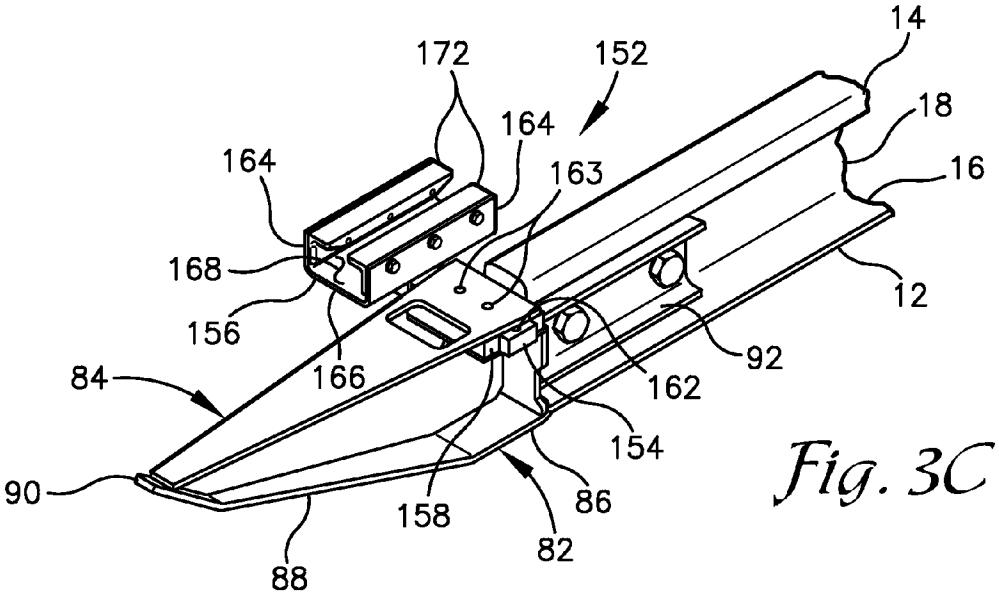
FIG. 3C is a perspective view of a rail with a shoe coupled to an end thereof and configured for use with the rail-guide system depicted in FIG. 3B.

Referring to the drawings in more detail, and to FIGS. 1-3 in particular, a rail train 10 is described in accordance with an embodiment of the invention. The train 10 is adapted for transporting a plurality of ribbon rails 12 along a railroad track (not shown). As shown in FIG. 3C, each rail 12 includes a head 14, a base or base flange 16 and a web 18 connecting the base flange 16 to the head 14. The base flange 16 may be described as including opposingly directed feet. The rail train 10 is made up of a plurality of cars 24, including front and rear end cars or tunnel cars 26 and 28, a tie-down car 30 and a plurality of rail support cars or rack cars 32. The train 10 is pulled along the track by one or more power units (not shown).

Referring to FIGS. 1-2, each rack car 32 includes a rail car base 34 supported on a pair of trucks or bogies 36 positioned near first and second ends 38 and 40 thereof. First and second stands or racks 42 and 44, for supporting rails 12 loaded on the rail train 1, extend upward from the rail car base 34 in inwardly spaced relation from the first and second ends 38 and 40 respectively. Each rack 42 and 44 is positioned inward from a corresponding rail car base end 38 and 40 approximately one quarter of the length of the rail car base 34. It is foreseen that each rack car 32 may include a single or multiple racks 42, 44 projecting upward therefrom and the rail car base 34 of adjacent rack cars 32 may be supported on shared bogies 36.

As best seen in FIGS. 1, 2, and 3A, each rack includes a pair of sidewalls 46 and 48 extending upward from the rail car base 34 on opposite sides thereof and a plurality of shelves 50, six in the embodiment shown, extending between the sidewalls 46 and 48 in vertically spaced alignment. It is to be understood that each of the other cars 24 in the rail train 10 includes some form of shelves or shelving supported in a corresponding vertical spaced alignment as shelves 50 of rack cars 32 for supporting the rails 12 at a desired support spacing generally across the entire length of the train 10.

As best seen in FIG. 3A, each shelf 50 is formed by a framework 54 supporting a plurality of flanged rollers 56, ten in the embodiment shown, between the sidewalls 46 and 48. The framework 54 comprises a pair of lateral struts 58 extending between and mounted to the sidewalls 46 and 48. Roller support struts, eleven in the embodiment shown, are connected to and extend between the lateral struts 58, longitudinally relative to the railcar base 34. Each roller 56 comprises a cylindrical roller body 62 mounted on a roller shaft 64 with flanges 66 formed on each end of the roller body 62 and projecting radially outward therefrom. The roller body 62 and the spacing between the flanges 66 on either end thereof is slightly wider than the base 16 of a rail 12 to be supported thereon. Ends of each roller shaft 64 are mounted to and supported on a roller support strut by a bearing assembly 68 such that the roller shafts 64 extend transverse relative to the length of the rail car base 34.

Referring to FIG. 3A, the area extending between the flanges 66 on each roller 56 and between the roller 56 and the shelf 50 spaced thereabove, defines what may be referred to as a pocket 70 for receiving a rail 12. The number of pockets 70 corresponds to the number of rollers 56 supported on each shelf 50. It is foreseen that each shelf 50 could be formed simply as a planar support surface across which the rails 12 slide and not with separate rollers or the like or structure defining separate spaces or pockets for each rail 12.

Each shelf 50 may include upward angling ramps 71 extending between the sidewalls 46 and 48 in front of each lateral strut 58 to urge the end of a rail 12 being loaded onto the shelf 50 upwards and onto the desired roller 56. Guide plates 72 and 74 may also be mounted to each sidewall 46 and 48 of each rack 42 and 44 and angle inward from an outer edge of each sidewall 46 and 48 toward the outermost roller support strut and roller 56 mounted thereon to help laterally guide the end of a rail 12 being loaded inward toward an outermost pocket 70 and onto the outermost roller 56.

Figure 7A:
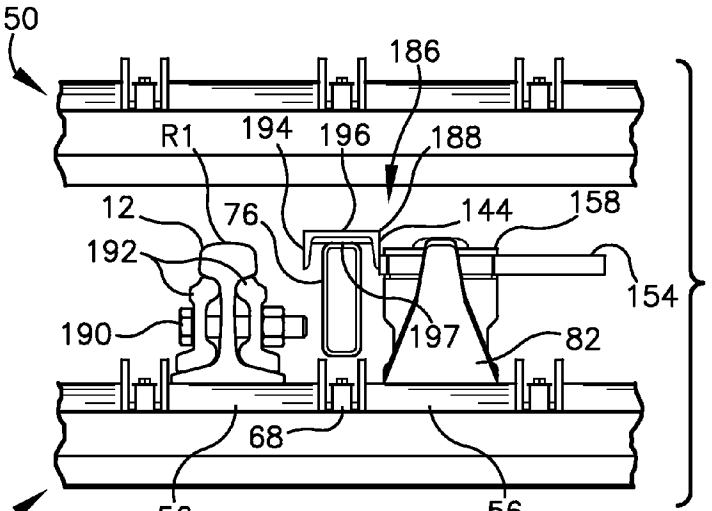
FIG. 7A is an enlarged, fragmentary, cross-sectional view of a rail car depicting a rail-guide system configured with a supported guide beam depicted in accordance with an embodiment of the invention.
Figure 6A:
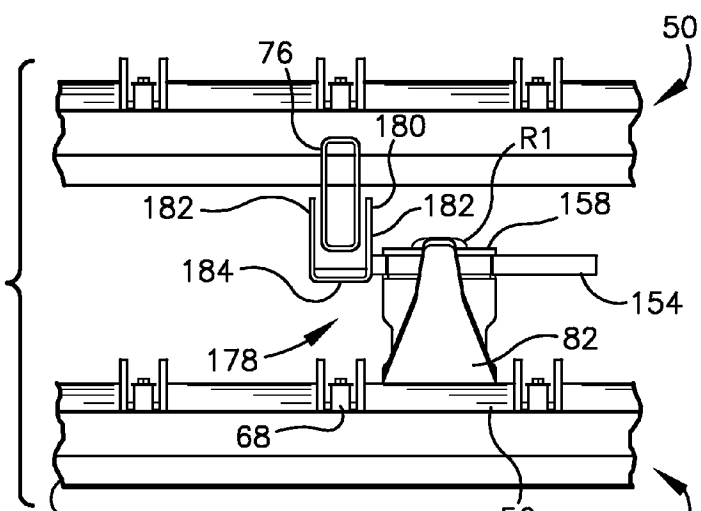
FIG. 6A is an enlarged fragmentary cross-sectional view of a rail car depicting another configuration of a rail-guide system in accordance with an embodiment of the invention.

A guide beam 76 is provided for each shelf 50 spanning or extending substantially the entire length of the rail car base 34. As depicted in FIG. 3A-B, the guide beam 76 comprises an I- or H-style beam or other style of beam having a base flange that is suspended or depends from a vertically adjacent shelf 50 or other cross-member. The guide beam 76 can take other forms, such as a channel, S-beam, or a square or rectangular tube, as depicted in FIGS. 6A and 7A. In the embodiment shown, the guide beam 76 is positioned overlying the centermost roller support strut and bearing assembly 68 of each shelf 50, but can be positioned in any location along the shelf 50. The guide beam 76 is located proximate a shelf 50 onto which the guide beam 76 is to be used for guiding a rail 12.

Figure 5B:
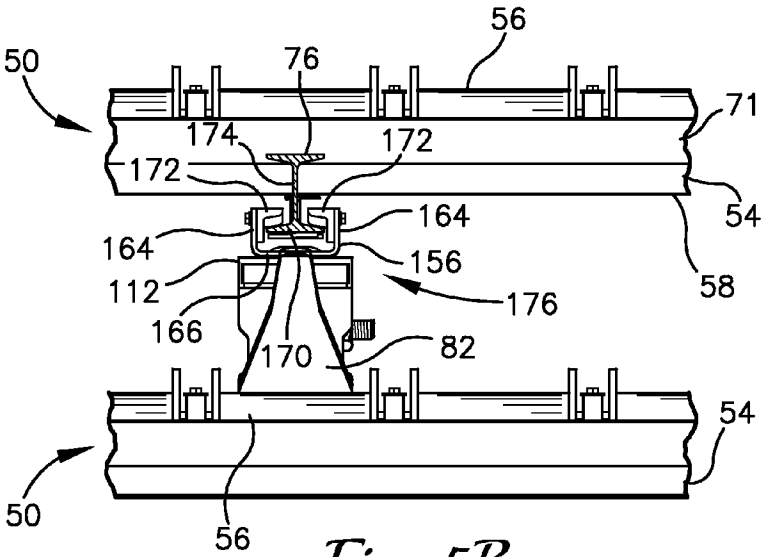
FIG. 5B is an enlarged fragmentary view of a rail-guide system shown in FIG. 5A.

A central location may provide better weight distribution of the empty rack car 32 as well as for partially loaded rack cars 32, because the rails 12 can be loaded from the center out thereby keeping the center of mass of the rack car 32 located generally over the longitudinal centerline of the car 32. The guide beam 76 might also be positioned directly overlying one of the flanged rollers 56, as depicted in FIGS. 5A-B, or the guide beam 76 can be disposed on the shelf 50 between a pair of the rollers 56, as depicted in FIG. 7A.

The guide beam 76 may be welded to the shelves 50 or to the framework 54 thereof. Or any variety of fasteners might be employed to couple the guide beam 76 to the shelves 50 and/or framework 54. In the embodiment shown, guide beam support stanchions 78 are provided at each end 38, 40 of the rail car base 34 and between the racks 42, 44 to support the ends and central portion of the guide beam 76. The stanchions 78 include cross-members 80 that couple to and support the guide beams 76 but may be configured so as not to provide support and/or to come into contact with the rails 12 loaded on the cars 32.

Figure 4A:
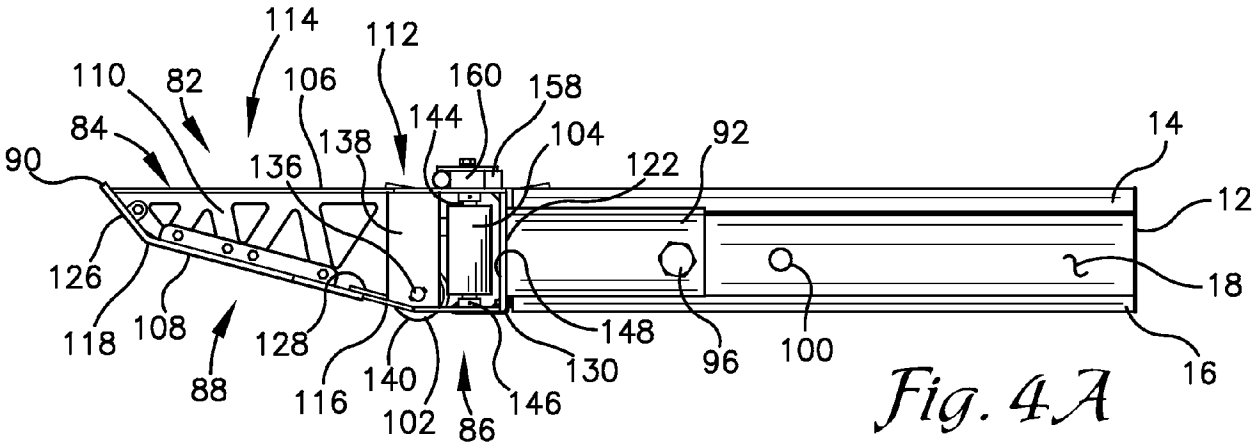
FIG. 4A is a side elevational view of a shoe that is useable with a rail-guide system in accordance with an embodiment of the invention.
Figure 4C:
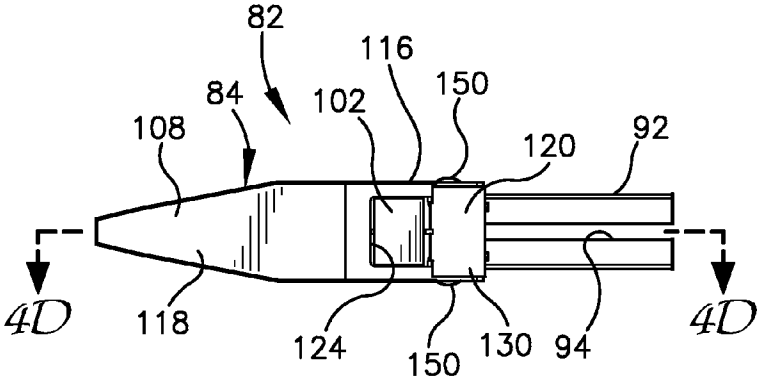
FIG. 4C is a bottom plan view of the shoe of FIG. 4A.
Figure 4B:
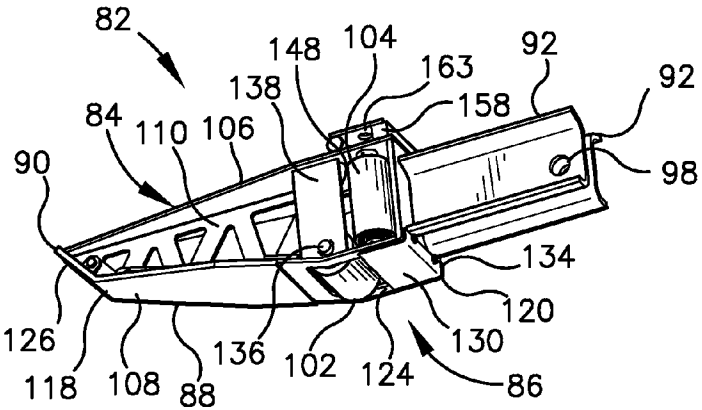
FIG. 4B is a perspective side view of the shoe of FIG. 4A taken from an underside of the shoe.

Referring to FIGS. 4A-E, a rail guide shoe 82 is attached to the front of each rail 12 loaded onto rail train 10 to facilitate threading the rail 12 onto the rail train 10 including through the selected, aligned pockets 70 associated with the racks 42 and 44 of each rack car 32. Each shoe 82 includes a shoe body 84, having a heel 86, a toe 88 projecting forward from the heel 86 in an inward taper to a blunt tip 90 and a pair of mounting legs 92 projecting rearward from the heel 86 in spaced apart relation to form a gap 94 therebetween. The gap 94, as best seen in FIG. 4C, is sized to receive the web 18 of a rail 12 at the leading end thereof with the legs 92 extending on opposite sides of and in closely space relation to the web 18 between the head 14 and base 16 of the rail 12. Each shoe 82 is bolted to an end of a rail 12 using a bolt 96 extending through holes 98 in the legs 92 aligned with a hole 100 in the web 18 of the rail 12.

Referring to the embodiment of the guide shoe 82 shown in FIGS. 4A-D, a horizontal roller 102 is rotatably mounted within and projects slightly below the shoe body 84 preferably at the interface between the toe 88 and heel 86. It is foreseen that the horizontal roller 102 might be positioned only within the heel 86 or only within the toe 88. A pair of vertical rollers 104 is rotatably mounted within and projects outward from sides of the shoe body heel 86. The vertical rollers 104 could be positioned further forward so as to generally extend at the interface between the heel 86 and toe 88 of the shoe body 84. The horizontal roller 102 preferably is sized to extend across a substantial portion of the width of the heel 86 of the shoe 82 and the vertical rollers 104 are sized to extend across a substantial portion of the height of the heel 86. It is to be understood that the shoe 82 might only include a horizontal roller 102 as in the embodiment shown in FIG. 4E or might not include either of the horizontal roller 102 or the vertical rollers 104. The comparable components of the two embodiments of the shoes shown are numbered consistently.

In the embodiments shown, the shoe body 84 is formed from steel plates welded together and the legs 92 are formed from rectangular channel members welded to the heel 86. It is to be understood that the shoe body 84 can be manufactured in any desired manner and from available component parts. For example, the shoe body 84 might be cast as a single casting and then machined to provide recesses for receiving the rollers 102 and 104.

Shoe body 84, as shown in FIGS. 4A-E, includes a planar, top plate 106, a base plate assembly 108 and an interconnecting web 110 extending between the top plate 106 and the base plate assembly 108. The top plate 106 forms an upper surface of both the heel 86 and toe 88 and may be described as being divided into a heel portion 112 and a toe portion 114. The base plate assembly 108 includes a base plate 116, front or toe skid plate 118 and rear or heel skid plate 120. A back plate 122 extends between the top plate 120 and the base plate 116 at the rear of the shoe body heel 86. A roller opening 124 is formed in the base plate 116 at the interface between the heel 86 and toe 88 portions of the shoe body 84 such that the opening 124 extends through both portions thereof. Holes may be formed in the web 110 and other portions of the plates forming the shoe body 84 to reduce its overall weight.

The toe skid plate 118 is removeably securable, by bolting to the interconnecting web 110 and angles upward and forward from the heel 86 to or just past the distal end of the top plate 106 at the tip 90 of the shoe 82. The toe skid plate 118 as shown includes an upturned portion 126 proximate the distal end thereof so that the tip 90 of the shoe 82 angles upward relative to the rest of the toe skid plate 118. Both the toe portion 114 of the top plate 106 and the toe skid plate 118 narrow or taper inward toward the tip 90 of the shoe 82 to form a bluntly pointed toe 88. When secured in place, an inner end of the toe skid plate 118 abuts against a support plate 128 welded to an inner surface of the base plate 116 so as to extend partially past an edge of the base plate 116 closest to the tip 90 of the toe 88.

As best seen in FIGS. 4A-D, the heel skid plate 120 includes a horizontal wear plate 130 that covers the base plate 116 between the roller opening 124 and the back plate 122 and front and rear mounting flanges 132 and 134. Front mounting flanges 132 extend upward into the horizontal roller opening 124 and into overlapping relationship with a rear edge thereof. The rear mounting flange 134 extends flush with or in abutment with a rear surface of the back plate 122 and is bolted thereto so that the heel skid plate 120 is removeably securable to the heel 86 of the shoe body 84 with the horizontal wear plate 130 extending over the portion of the base plate 116 extending rearward from the roller opening 124.

The toe skid plate 118 and heel skid plate 120 are adapted to be replaceable due to wear. It is foreseen that the toe skid plate 118 could be integrally formed with the base plate 116 and have wear ribs or the like formed thereon which could be rebuilt after wearing down. Similarly wear ribs or the like could be formed on the base plate 116.

When the shoe 82 is bolted to a rail 12, the bottom surface of the base plate 116 extends generally in planar alignment with the bottom surface of the rail base 16 and in closely spaced relation thereto. The heel skid plate 120 preferably extends below the bottom surface of the rail base 16. The upward and forward slope of the toe skid plate 118 urges the end of the rail 12 upward as the toe skid plate 118 engages horizontal edges such as the ramps 71 of each shelf 50 to ensure that the end of the rail 12 is raised into proper vertical alignment with the surfaces over which it is to be slid, such as the rollers 56.

The horizontal roller 102 is mounted on a shaft 136 which is supported on and extends between vertical supports 138 extending between the top plate 106 and base plate 116 on opposite sides of the shoe body 84. The horizontal roller shaft 136 is supported above the opening 124 such that a lower circumferential edge 140 of the horizontal roller 102 extends below the base plate 116, the heel skid plate 120 and the toe skid plate 118. An axis of the horizontal roller 102 extends generally horizontally and transverse to a direction of travel of the shoe 82. Most of the horizontal roller 102 extends within the shoe body 84 and may be described as being recessed therein or positioned within a recess in the shoe body 82. A recess 142 is also formed in the web 110 to accommodate the horizontal roller 102. The horizontal roller 102 is preferably of a type having bearings (not shown) integrated therein. The horizontal roller 102 functions to facilitate movement of the shoe 82 over the ramps 71 and across the lateral struts or supports 58 forming the shelves 50 and any other horizontal structure across which it is advanced to facilitate threading a rail 12 through selected aligned pockets 70 of the successive shelves 50 of the rack cars 32 and other cars of the rail train 10.

The vertical rollers 104 are mounted on shafts 144 supported between the heel portion 112 of top plate 106 and the base plate 116 extending therebelow such that the axis of the vertical rollers 104 generally extends transverse to a direction of travel of the shoe 82. Each shaft 144 is supported in a bearing 146 connected to the top plate 106 and the base plate 116. A vertical roller gap or opening 148 extends between each vertical support 138 and the back plate 122 of the shoe body 84 through which a portion of the associated vertical roller 104 extends. An outer circumferential edge 150 of each vertical roller 104 extends outward, past outer edges of the top plate heel portion 112 and the base plate 116. Most of each vertical roller 104 extends within the shoe body 84 and may be described as being recessed therein or positioned within a recess in the shoe body 82. The vertical rollers 104 facilitate movement of the shoe 82 relative to any vertically extending surfaces it may advance against.

Figure 4E:
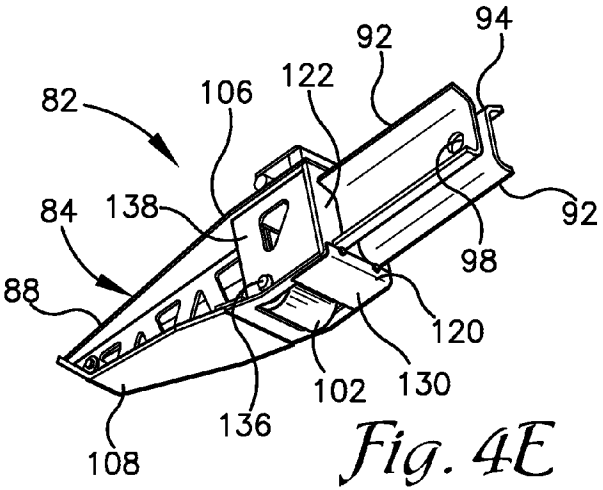
FIG. 4E is side perspective view of another shoe configured without side rollers depicted in accordance with an embodiment of the invention.
Figure 4D:
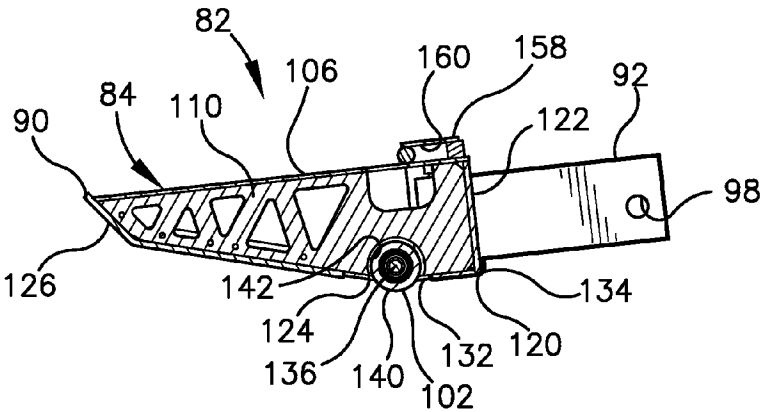
FIG. 4D is a cross-sectional elevational view of the shoe of FIG. 4A taken along the line 4D-4D depicted in FIG. 4C.

In the embodiment of the shoe 82, as shown in FIG. 4E, having only a horizontal roller 102, the vertical supports 138 which support the horizontal roller shaft 136 preferably extend the complete length and height of the heel 86, without a roller receiving gap 148 formed therein and are connected to the back plate 122.

Returning to FIGS. 3A-C, an offset rail guide 152, including a guide arm 154 and an upwardly opening channel member or follower 156 coupled along the guide arm 154, is selectively securable to the shoe 82 in a guide arm receiver 158. The rail guide 152 is used to guide the shoe 82 and the rail 12 to which it is connected along the selected guide beam 76 to facilitate threading the rail 12 into a selected pocket 70 that is located to one side of the guide rail 76. The guide arm receiver 158 is mounted or formed in the heel portion 112, as shown in FIGS. 3B-C, or on top of the heel portion 112 of top plate 106 of the shoe body 84, as shown in FIGS. 4A-E. A slot 160, sized to receive the guide arm 154, extends through the receiver 158 transverse to the longitudinal axis of the shoe 82 and across the width of the heel 86 of the shoe body 84. The guide arm 154 can be inserted into the receiver slot 160 from either end so that the follower 156 can be positioned on either side of the shoe body 84. A plurality of threaded, spacing-selection holes 162 are formed in the guide arm 154 and are selectively engageable by screws, threaded through holes 163 in the top of the receiver 158 to allow adjustment to the spacing of the follower 156 from the shoe body 84.

The follower 156 includes a pair of flanges 164 projecting upward from and connected together by a web 166 to form an upwardly opening channel 168. The flanges 164 are spaced apart a distance sized to receive a base flange 170 of the guide beam 76 therebetween. The follower 156 is mounted transverse to the guide arm 154 at a distal end thereof, such that when the guide arm 154 of the rail guide 152 is secured in the receiver 158, the channel 168 extends in parallel alignment with the guide beam 76 and the rail 12 to which the shoe 82 is attached.

A capture member 172 is disposed at a distal edge of each of the flanges 164 and extends toward the opposite flange 164 generally parallel to the web 166. As such, the capture members 172 are configured to partially enclose the channel 168 so as to receive the base flange 170 of the guide beam 76 within the channel 168 between the capture members 172 and the web 166 and to allow a web 174 of the guide beam 76 to pass between the capture members 172 and out of the channel 168. The base flange 170 of the guide beam 76 can thus be captured in the follower 156 to allow the follower 156 to slide thereallong to direct a rail 12 being loaded into a desired pocket 70. The capture members 172 may be formed from or provide a bearing surface comprised of a material that aids sliding of the capture members 172 along the base flange 170, such as, for example, a bronze or brass alloy, nylon, plastic, or the like. In one embodiment, the capture members 172 include one or more bearings, rollers, or the like.

Figure 5C:
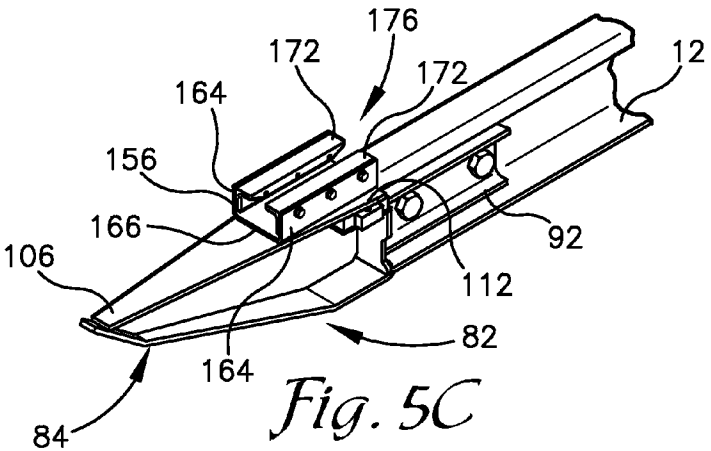
FIG. 5C is a perspective view of a shoe coupled to a rail and configured for use with the rail-guide system depicted in FIGS. 5A-B.
Figure 5A:
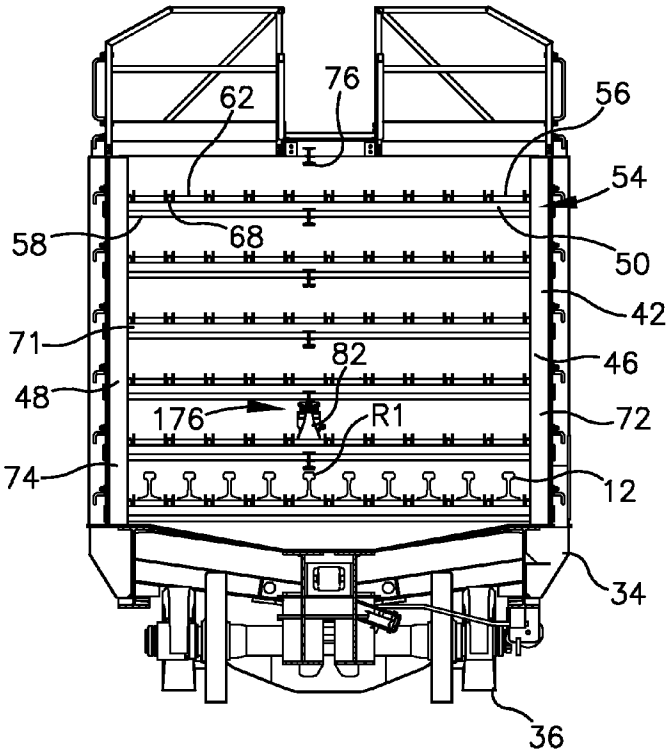
FIG. 5A is a cross-sectional view of the rail car similar to FIG. 3A showing depending rail-guide beams located inline with pockets on the rail car depicted in accordance with an embodiment of the invention.

In another embodiment depicted in FIGS. 5A-C, an inline rail guide 176 configured for use with the guide beam 76 positioned overlying the flanged roller 56 and the pocket 70 in which the initial rail is to be inserted is provided. The follower 156 of the inline rail guide 176, constructed similar to the follower 156 of the embodiment shown in FIGS. 3B-C, is mounted or formed directly on top of the heel portion 112 of the top plate 106 of the shoe body 84. The follower 156 might alternatively be coupled to the shoe 82 in another location. Engagement of the follower 156 with the base flange 170 of the guide beam 76 places the shoe 82 and the rail 12 coupled thereto in vertical alignment with the guide beam 76. Such vertical alignment may reduce twisting or sagging of the end of the rail 12 or shoe 82 about the coupling between the follower 156 and the guide beam 76 as might be encountered when the offset rail guide 152 described previously is employed.

Figure 6B:
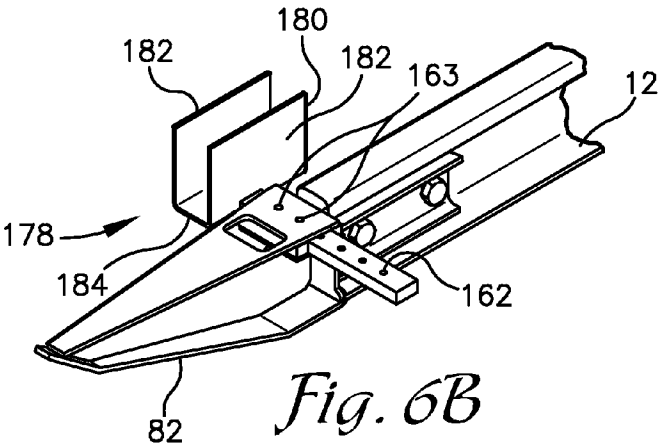
FIG. 6B is a perspective view of a shoe configured for use with the rail-guide system of FIG. 6A depicted in accordance with an embodiment of the invention.

With reference now to FIGS. 6A-B, a second offset rail guide 178 is described in accordance with an embodiment of the invention. The second offset rail guide 178 includes a follower 180 configured to receive tubular-shaped guide beam 76 therein. The follower 180 comprises a channel formed by a pair of flanges 182 that extend upwardly from a web 184. The flanges 182 are spaced apart a sufficient distance to receive at least a portion of the tubular-shaped guide beam 76 therein; the guide beam 76 depends downwardly from an overlying shelf 50 or framework 54 thereof and overlying a roller support strut and/or bearing assembly 68 of the respective shelf 50. In this configuration, the engagement of the follower 180 with the guide bar 76 provides lateral guidance, e.g. side-to-side across the car 32, of the shoe 82 and rail 12 being loaded but does not vertically support the shoe 82 or the end of the rail 12.

Figure 7B:
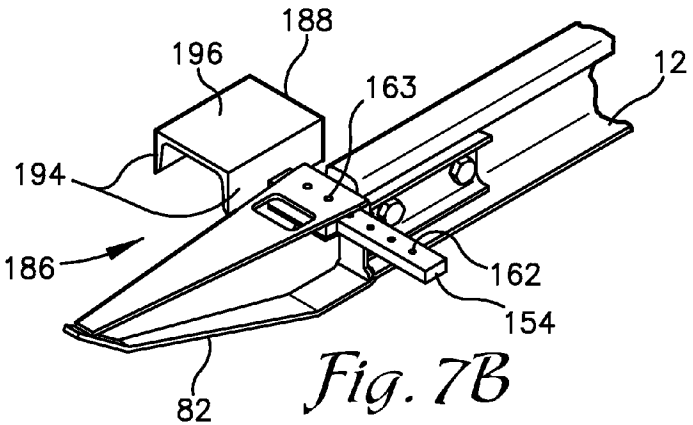
FIG. 7B is a perspective view of a shoe coupled to a rail and configured for use with the rail-guide system shown in FIG. 7A depicted in accordance with an embodiment of the invention.

A third offset rail guide 186 is depicted in FIGS. 7A-B and is described in accordance with an embodiment of the invention. The third offset rail guide 186 is configured for use with a guide beam 76 that is disposed on the shelf 50 between a pair of flanged rollers 56. The guide beam 76 can have any cross sectional profile that presents a top surface that a follower 188 of the third offset rail guide 186 can engage; a rectangular profile is depicted in FIG. 7A. Preferably the guide beam 76 has a profile that does not interfere with bolts 190 and joint bars 192 coupled to the rail 12.

The follower 188 is disposed at a distal end of the guide arm 154 and includes a pair of downwardly extending flanges 194 with a web 196 disposed therebetween. The flanges 194 are sufficiently spaced to receive the guide beam 76 therebetween with the web 196 preferably in contact with an upper surface of the guide beam 76. The length and spacing of the flanges 194 can be configured to provide a desired engagement with the guide beam 76, e.g. longer flanges that snuggly fit on the guide beam 76 may more substantially resist sagging of the shoe 82 or rail 12 about the coupling of the follower 188 with the guide beam 76 but may also result in greater friction therebetween. One or more wear plates 197 or sliding surfaces, such as bronze, brass, nylon, or plastic plates, among others can be disposed on the follower 188 to aid sliding of the follower 188 along the guide beam 76.

With reference now to FIGS. 8A-D, a bridge 198 is described in accordance with an embodiment of the invention. The bridge 198 is configured to couple between opposing ends of corresponding guide beams 76 of adjacent cars 24, e.g. the bridge 198 connects the guide beams 76 of each of the cars 24 to form a continuous beam extending the length of the rail train 10. As depicted herein, the bridge 198 is configured for use with a guide beam 76 that comprises an I- or H-shaped beam depending downwardly from shelves 50 or the framework 54 thereof of racks 42, 44 of the cars 24. However, the bridge 198 can be configured to couple between guide beams 76 of other profiles or that are disposed on the shelves 50 as depicted in FIGS. 6A and 7A and discussed previously.

Figure 8A:
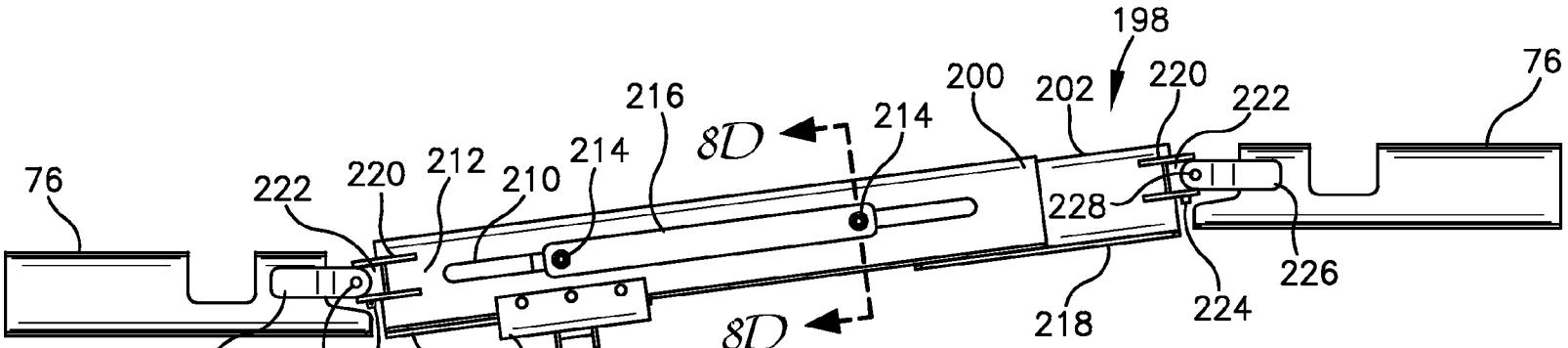
FIG. 8A is a side elevational view of a bridge coupled between guide beams of consecutive rail cars in accordance with an embodiment of the invention.
Figure 8B:
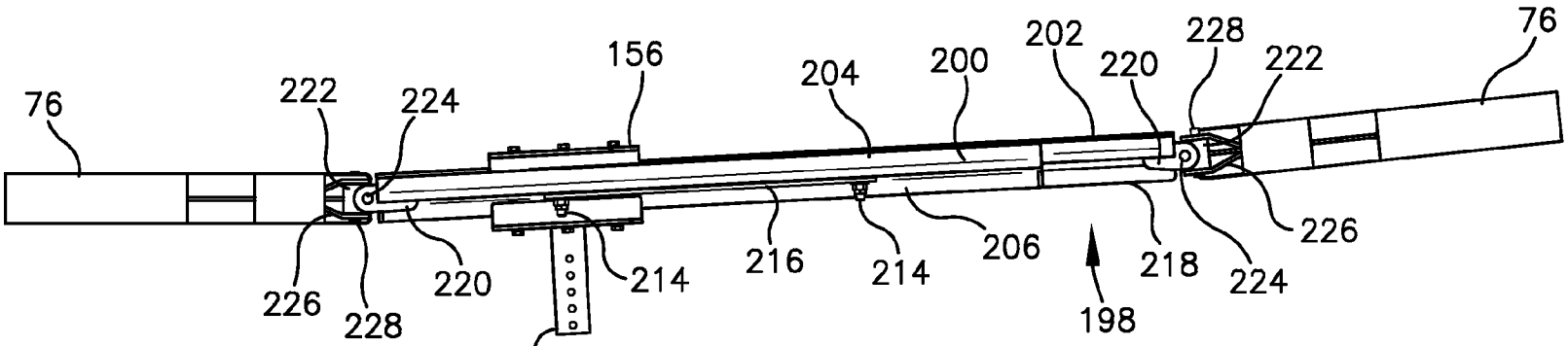
FIG. 8B is a top elevational view of the bridge of FIG. 8A.
Figure 8C:
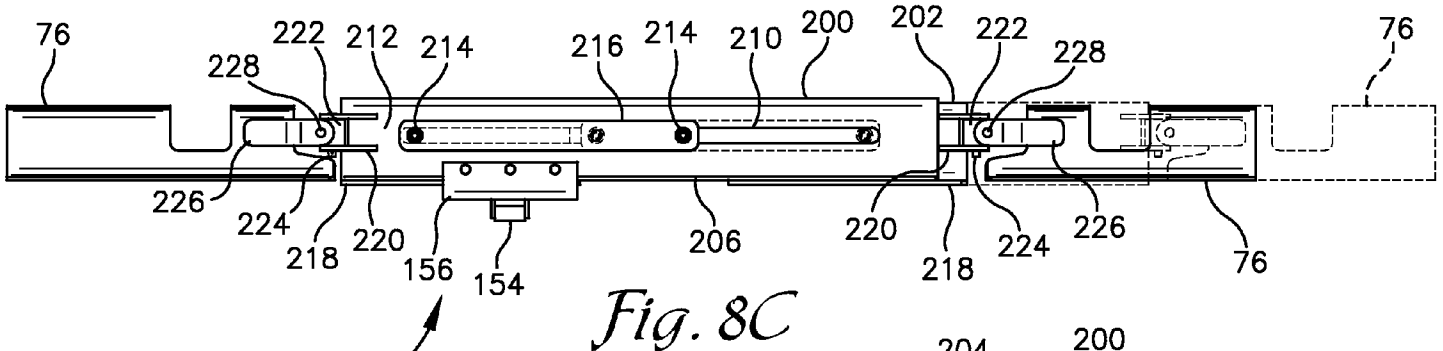
FIG. 8C is a side elevational view of the bridge of FIG. 8A depicting the bridge in retracted and extended positions in accordance with an embodiment of the invention.
Figure 8D:
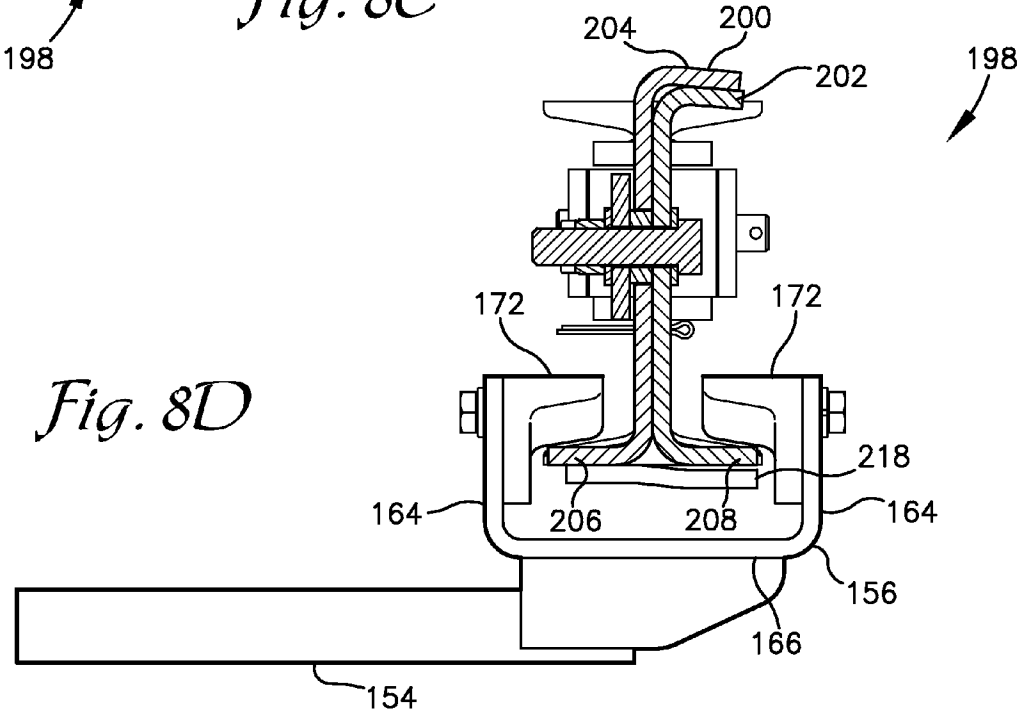
FIG. 8D is a cross-sectional view of the bridge of FIG. 8A taken along the line 8D-8D.

The bridge 198 comprises a first and a second elongate member 200, 202 disposed parallel to and alongside one another. As shown in FIG. 8D the first member 200 includes an S-shaped cross-sectional profile while the second member 202 is a channel member that nests into an upper flange 204 of the first member 200. The first and second members 200, 202 are dimensioned to present an I- or H-shaped lower profile similar to an I- or H-beam when nested in such a manner, e.g. a lower flange 206 of the first member 200 and a lower flange 208 of the second member 202 are disposed in a common plane and extend in opposite directions to resemble the foot of an I- or H-beam. It is understood that other profiles and configurations can be employed without departing from the scope of embodiments described herein.

The first and second members 200, 202 are slideably coupled together via an elongate slot 210 in a web 212 of the second member 202. A pair of bolts 214 or other fasteners is fastened through the first and second members 200 and 202, through the slot 210, and through a reinforcing strap or washer plate 216. The pair of bolts 214 are spaced apart along a portion of the length of the slot 210 so as to enable the bolts 214 to slide along the slot 210 and thus to enable the first and second members 200, 202 to slide longitudinally with respect to one another, as shown in FIG. 8C. The first and second members 200, 202 thus form a bridge 198 that is extensible longitudinally along the length thereof. The bridge 198 may be configured to extend any desired distance but preferably has a range of motion of up to about 24 inches, or preferably up to about 12 inches. Such extensibility enables the bridge 198 to accommodate relative longitudinal movement between the cars 24 as a result of, for example, coupler slack take up.

A flange extension plate 218 is provided on a portion of the first and the second members 200, 202 to ensure that a full base flange profile is maintained along the length of the bridge 198 throughout the range of motion of extension thereof. The flange extension plates 218 comprise generally planar sections of material that are welded or otherwise coupled to bottom surfaces of the lower flanges 206, 208 at opposite ends of the first and second members 200, 202. When the bridge 198 is retracted, the flange extension plates 218 underlie the respective lower flanges 206, 208 of the first and second members 200, 202, e.g. the plate 218 coupled to the first member 200 underlies the lower flange 208 of the second member 202. When the bridge 198 is extended, the first and second members 200, 202 do not completely overlap and thus leave a portion of the length of the bridge 198, at each end thereof, without one of the lower flanges 206, 208. In these portions, the flange extension plates 218 are exposed and provide a substitute flange upon which the follower 156 can travel.

The bridge 198 is also configured to pivot vertically and horizontally about each end thereof to accommodate such relative movements between the cars 24. The bridge 198 includes a horizontally disposed clevis 220 at each end thereof. A pivot body 222 is disposed in each clevis 220 and a pin 224 is installed therethrough to enable the pivot body 222 to pivot about a generally vertical axis defined by the pin 224. The pivot body 222 is further installed in a vertically disposed clevis 226 that is coupled to an end of the guide beam 76 extending from the cars 24. A second pin 228 is inserted through the vertically disposed clevis 226 and through the pivot body 222 to enable the pivot body 222 to pivot about a generally horizontal axis defined by the pin 228. As such, each end of the bridge 198 is able to pivot vertically about the horizontally oriented pins 228 and laterally or side-to-side about the vertically oriented pins 224. The bridge 198 thus accommodates up to about ten inches of relative vertical movement between adjacent cars 24, or more preferably up to about six inches of vertical travel. The bridge 198 also provides lateral pivotal movements between the cars 24 sufficient to accommodate travel of the cars 24 around up to about a fifteen degree turn or more preferably up to about a twelve degree turn.

With reference again to FIGS. 1-3C, operation of the guide system is described in accordance with an embodiment of the invention. In loading the first rail r1 on each set of shelves 50 of the cars 24 of a rail train 10, a guide shoe 82, with the offset rail guide 152, is secured to the leading end of the rail 12. The shoe 82 and the end of the rail r1 to which it is attached is positioned or aligned to receive the base flange 170 of the guide beam 76 into the follower 156. The rail r1 is then threaded through the selected set of pockets 70 on the aligned shelves 50 of the cars 24 by sliding or following of the follower 156 along the guide beam 76. When the rail train 10 is resting on a curve, and a rail r1 is being loaded through pockets 70, as the end of the rail r1 is advanced from the second end 40 of one rack car 32 to the front 38 of the next, the end of rail r1 being loaded will tend to move in a straight line rather than bend into alignment with the appropriate pocket 70 of the next car 32. Engagement of the follower 156 with the guide beam 76 resists such straight-line movement and directs the rail r1 into the desired pocket 70 of the next car 32 and over the corresponding flanged roller 56 in the first rack 31.

Additionally, when the rail being loaded passes from a first rack car 32 to a second rack car 32, the follower 156 leaves the guide beam 76 of the first rack car 32 and engages the bridge 198 which spans between the guide beams 76 of the first and second cars 32. The follower 156 thus receives the lower flanges 206, 208 and/or the flange extension plates 218 into the channel 168 therein and slides therealong toward the corresponding guide beam 76 of the second rack car 32. Upon reaching the guide beam 76 of the second rack car 32, the follower 156 engages the guide beam 76 and continues along its path.

Figure 9:
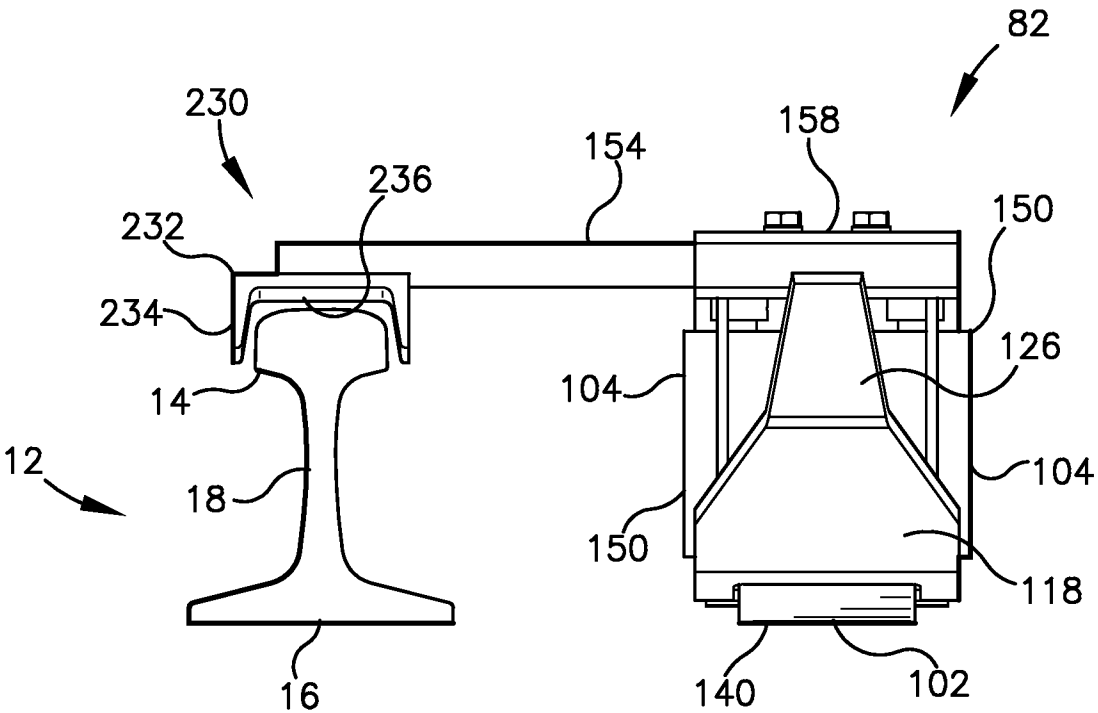
FIG. 9 is a front elevational view of a shoe with a rail-spacing guide coupled thereto and engaging a previously loaded rail.

Guide beams 76 are preferably only mounted in alignment with one or two of the pockets 70 on each shelf 50 because once a rail 12 is loaded onto the shelf 50, the remaining rails 12 can be guided onto the shelves 50 and through the desired pockets 70 in the proper spacing and alignment using a rail spacing guide 230 in association with the guide shoe 82 as generally shown in FIG. 9 which shows a second rail r2 being guided into position adjacent the first rail r1.

As depicted in FIG. 9, the rail spacing guide 230 is configured similarly to the offset rail guide 152 discussed previously (features thereof are similarly labeled), but the follower 156 is replaced with a downwardly opening channel member 232. The channel member 232 includes a pair of flanges 234 extending downwardly from and connected by a web 236 therebetween. The flanges 234 are sufficiently spaced and aligned to receive the head 14 of a rail 12 that has been previously loaded on the cars 24 therebetween. The channel member 232 is coupled to the guide arm 154. The guide arm 154 is positioned within the receiver 158 so that when the channel member 232 is positioned over the head 14 of the first or previously loaded rail 12, the rail 12 which is then being loaded, and to which the shoe 82 is attached, is spaced away from the previously loaded rail a distance corresponding to the distance between centers of adjacent pockets 70 on each shelf 50 which corresponds to the distance between the centers of adjacent flanged rollers 56 on each shelf 50. As the rail 12 is then loaded the connection of the rail spacing guide 230 between the rail 12 being loaded and the previously loaded rail 12 guides the rail 12 being loaded through the desired set of aligned pockets 70.

As depicted in FIG. 7A, a configuration with the guide beam 76 disposed or positioned on top of the shelf 50 may require use of the guide beam 76 for loading of a rail 12 on each side thereof. The configuration of the guide beam 76 may interfere with or block the use of the rail spacing guide 230 for loading of rails 12 on opposite sides of the guide beam 76.

Referring again to FIGS. 1 and 2, a catwalk 238 is supported above the racks 42 and 44 on a support frame assembly 240. Lateral runs 242 of the catwalk 238 extend directly over the racks 42 and 44 and are supported between the rack sidewalls 46 and 48. A longitudinal run 244 extends down the middle of the rack car 32 across each lateral run 242 and from end to end 38 and 40 of the rack car 32. An operator can monitor the loading of rails 12 onto the rack cars 32 from the catwalk 238 and take any required action therefrom. Ladder rungs 246 are mounted on the rack sidewalls 46 and 48 to provide access to the catwalk 238.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A system for loading railroad rails on a rail train, the system comprising:

a rail train including a plurality of rack cars having a base supported on opposite ends by rail car trucks, each rack car including a stand that provides a shelf configured to receive a plurality of ribbon rails thereon;

a guide beam depending downward over the shelf from an overlying shelf or cross-member, the guide beam being positioned over the pocket or between adjacent pockets on the shelf and spanning substantially the length of the rack car; and a shoe coupleable to a leading end of a ribbon rail to be loaded on the shelf, the shoe including a follower that engages the guide beam to guide the shoe and a ribbon rail to which the shoe is coupled into a pocket on the shelf as the ribbon rail is loaded onto the rack cars.

2. The system of claim 1, wherein the follower comprises a pair of spaced apart flanges extending from a web to form a channel in which a portion of the guide beam is received.

3. The system of claim 1, wherein the follower is coupled to a top plate of the shoe or to an arm that extends transversely to a longitudinal axis of the shoe.

4. A system for loading railroad rails on a rail train, the system comprising:

a rail train including a plurality of rack cars having a base supported on opposite ends by rail car trucks, each rack car including a stand that provides a shelf configured to receive a plurality of ribbon rails thereon;

a guide beam associated with the shelf and spanning substantially the length of the rack car;

a shoe coupleable to a leading end of a ribbon rail to be loaded on the shelf, the shoe including a follower that engages the guide beam to guide the shoe and a ribbon rail to which the shoe is coupled into a pocket on the shelf as the ribbon rail is loaded onto the rack cars; and wherein the guide beam includes a base flange and wherein the follower engages the base flange of the guide beam.

5. The system of claim 4, wherein the follower comprises a channel formed by a pair of spaced apart flanges extending upwardly from opposite edges of a web, each flange including an inwardly extending portion that extends in a direction toward the opposite flange to at least partially overlie the web, the channel being configured to receive the base flange of the guide beam between the flanges and between the web and the inwardly extending portions.

6. The system of claim 5, wherein the inwardly extending portions comprise wear plates that aid sliding of the follower along the guide beam.

7. The system of claim 1, wherein the guide beam comprises a tubular beam.

8. A system for loading railroad rails on a rail train, the system comprising:

a rail train including a plurality of rack cars having a base supported on opposite ends by rail car trucks, each rack car including a stand that provides a shelf configured to receive a plurality of ribbon rails thereon;

a guide beam associated with the shelf of each rack car and spanning substantially the length of the rack car;

a shoe coupleable to a leading end of a ribbon rail to be loaded on the shelf, the shoe including a follower that engages the guide beam to guide the shoe and a ribbon rail to which the shoe is coupled into a pocket on the shelf as the ribbon rail is loaded onto the rack cars; and a bridge coupled between opposing ends of the guide beams on adjacent rack cars of the rail train, the bridges and the guide beams forming a continuous guide beam extending substantially the length of the plurality of rack cars.

9. The system of claim 8, wherein the guide beam extends upwardly from the shelf between adjacent pockets thereof and wherein the follower is coupled to the shoe by an arm extending transversely to the shoe, the follower including a pair of flanges extending downwardly from a web to form a downwardly opening channel configured to receive the guide beam therein and to slide therealong.

10. The system of claim 9, further comprising a wear plate disposed within the channel of the follower.

11. The system of claim 8, wherein the bridge is extensible to accommodate relative longitudinal movements between the rack cars.

12. The system of claim 11, wherein the bridge comprises:

a first member having an S-shaped cross-sectional profile with a first upper flange and a first lower flange connected by a first web, the first upper flange and the first lower flange extending in opposite directions and from opposite edges of the first web;

a second channel-shaped member having a second upper flange, a second lower flange, and a second web, the second member nesting against the first upper flange to place the first and second lower flanges in a common plane and extending in opposite directions, the first and second lower flanges forming a cross-sectional profile mimicking that of a lower flange of the guide beam, the guide beam having an I-shaped or H-shaped cross-sectional profile, wherein the first and second members are slideably coupled to enable longitudinal sliding movement therebetween.

13. The system of claim 12, wherein a first flange extension plate is coupled along a portion of the length of the first lower flange of the first member and a second flange extension plate is coupled along a portion of the length of the second lower flange of the second member, the first and second flange extension plates at least partially substituting for the second and first lower flanges, respectively, when the bridge is at least partially extended.

14. The system of claim 8, wherein the bridge is pivotably coupled to the guide beam, the pivotable coupling enabling pivoting of the bridge about a substantially horizontal axis.

15. The system of claim 8, wherein the bridge is pivotably coupled to the guide beam, the pivotable coupling enabling pivoting of the bridge about a substantially vertical axis.

16. The system of claim 8, wherein the rail train includes a tie-down car and front and rear end cars, and wherein the guide beam extends along at least a portion of the length of the tie-down car and the front and rear end cars.

17. A rail car for a rail train comprising:

a rail car base supported on opposite ends by rail car trucks;

a plurality of rail support shelves supported above the rail car base;

a plurality of guide beams, each guide beam mounted on the rail car proximate a respective one of said plurality of rail support shelves, each of said guide beams spanning substantially the length of the rail car; and a shoe configured to be coupled to a leading end of a ribbon rail to be loaded on one of the plurality of rail support shelves, the shoe including a follower that engages the guide beam and that is guided by the guide beam as the ribbon rail is loaded onto the rail train to direct the shoe and the ribbon rail into a pocket on the respective rail support shelf; and wherein the guide beam depends downward over the rail support shelf from an overlying shelf or cross-member, the guide beam being positioned over the pocket or between adjacent pockets on the rail support shelf.

18. The rail car as in claim 17, wherein the guide beam comprises a tubular beam.

19. The rail car as in claim 17, wherein the follower comprises a pair of spaced apart flanges extending from a web to form a channel in which a portion of the guide beam is received.

20. The rail car as in claim 17, wherein the follower is coupled to a top plate of the shoe or to an arm that extends transversely to a longitudinal axis of the shoe.

21. A rail car for a rail train comprising:

a rail car base supported on opposite ends by rail car trucks;

a plurality of rail support shelves supported above the rail car base;

a plurality of guide beams, each guide beam mounted on the rail car proximate a respective one of said plurality of rail support shelves, each of said guide beams spanning substantially the length of the rail car; and a shoe configured to be coupled to a leading end of a ribbon rail to be loaded on one of the plurality of rail support shelves, the shoe including a follower that engages the guide beam and that is guided by the guide beam as the ribbon rail is loaded onto the rail train to direct the shoe and the ribbon rail into a pocket on the respective rail support shelf, and wherein the follower engages a base flange of the guide beam.

22. The rail car as in claim 21, wherein the follower comprises a channel formed by a pair of spaced apart flanges extending from a web, each flange including an inwardly extending portion that extends from a distal edge of the flange in a direction toward the opposite flange, the channel being dimensioned to receive the base flange of the guide beam between the flanges and between the web and the inwardly extending portions.

23. A rail car for a rail train comprising:

a rail car base supported on opposite ends by rail car trucks;

a rail support shelf supported above the rail car base;

a guide beam mounted on the rail car and supported over the rail support shelf and depending from an overlying shelf or cross-member and spanning substantially the length of the rail car; and a follower configured for attachment to a leading end of a ribbon rail being loaded on the rail support shelf, the follower slidingly engaging the guide beam and directing the ribbon rail into a desired location on the rail support shelf as the ribbon rail is loaded onto the rail train.

24. A rail car for a rail train comprising:

a rail car base supported on opposite ends by rail car trucks;

a rail support shelf supported above the rail car base;

a guide beam mounted on the rail car proximate the rail support shelf and spanning substantially the length of the rail car;

a follower configured for attachment to a leading end of a ribbon rail being loaded on the rail support shelf, the follower slidingly engaging the guide beam and directing the ribbon rail into a desired location on the rail support shelf as the ribbon rail is loaded onto the rail train; and a bridge coupled to an end of the guide beam, the bridge being coupleable to a second guide beam of a similarly configured rail car that is coupled to the rail car to provide continuous engagement with the follower as the follower passes between the rail cars.

* * * * *